US005320211A

United States Patent [19]

Sugiura

[11] Patent Number: 5,320,211

[45] Date of Patent: Jun. 14, 1994

[54] BACKSTOP DEVICE OF CARRIER IN TROLLEY CONVEYOR

[75] Inventor: Tetsuya Sugiura, Saitama, Japan

[73] Assignee: Tsubakimoto Chain Co., Osaka, Japan

[21] Appl. No.: 68,824

[22] Filed: May 28, 1993

[30] Foreign Application Priority Data

Jun. 4, 1992 [JP] Japan ..... 4-044396[U]

[51] Int. Cl.[5] ..... B65G 17/32

[52] U.S. Cl. ..... 198/685; 198/465.4; 104/172.4

[58] Field of Search ..... 198/465.4, 684, 685; 104/172.4

[56] References Cited

U.S. PATENT DOCUMENTS 3,397,650 8/1968 Kondur et al. ..... 104/172.4
3,759,189 9/1973 DeSilets ..... 104/172.4
3,986,458 10/1976 Kling ..... 104/172.4
3,995,561 12/1976 Allor, Jr. ..... 104/172.4
4,245,562 1/1981 Knudsen ..... 198/685 X

FOREIGN PATENT DOCUMENTS 0035730 3/1980 Japan ..... 104/172.4
0753739 8/1980 U.S.S.R. ..... 198/465.4
1079555 3/1984 U.S.S.R. ..... 198/685

*Primary Examiner*—James R. Bidwell
*Attorney, Agent, or Firm*—Woodling, Krost & Rust

[57] ABSTRACT

A backstop device of a carrier in a trolley conveyor having the carrier riding on a traveling rail in and out of engagement with a travelling chain. The carrier has traveling rollers with backstop rings fixedly and interiorly mounted thereupon. Each of the backstop rings has a multitude of backstop holes on the circumference of the peripheral surface of the backstop rings for engagement with a pawl.

8 Claims, 4 Drawing Sheets

BACKSTOP DEVICE OF CARRIER IN TROLLEY CONVEYOR

INDUSTRIAL FIELD OF UTILIZATION

The present invention relates to a backstop device of a carrier in an overhead-type and a floor-type trolley conveyor.

PRIOR ART

Carriers of the trolley conveyor are designed to travel in engagement with a traveling chain. Each carrier is provided with a collision preventive means for disengaging a following carrier from the traveling chain by a preceding carrier in order that the following carrier will not collide against the preceding carrier when the preceding carrier is at a stop.

The carrier that has been disengaged from the traveling chain is in an unrestricted condition in which the carrier can freely travel on the traveling rail, and therefore the carrier is likely to move in an opposite direction because of the inclination of the traveling rail or an external force, resulting in trouble or an unexpected accident in conveying work. To prevent this, there has been used a carrier backstop technique as disclosed in for example Japanese Utility Model Laid-Open No. 159688/1979 gazette.

That is, the technique disclosed in the aforesaid gazette, as shown in FIG. 4, is of such a design that when a carrier C is traveling in the direction of the arrow a, a brake cam B swingably suspended on the carrier is rotated counterclockwise into sliding contact with the running surface of a carrier traveling rail R; if the carrier C tends to travel in the reverse direction of the arrow a, the brake cam B swings clockwise to engage the cam surface B' of the brake cam with the traveling surface of the traveling rail, thus preventing the reverse travel of the carrier C.

PROBLEM TO BE SOLVED BY THE INVENTION

According to the above-described backstop means of prior art, the brake cam B mounted on the carrier engages with the traveling surface of the traveling rail R of the carrier to prevent reverse run of the carrier; therefore, for example, when an article being carried by the carrier requires a specific processing, the carrier backstop operation is often concentrated in a specific point of the traveling rail because the carrier is released from the traveling chain and stopped in the processing position.

This backstop means, however, has such a drawback that the rail surface at the specific point will get excessively worn due to brake cam application, resulting in a decreased backstop effect on the traveling rail of the brake cam.

MEANS FOR SOLVING THE PROBLEM

In the present invention, therefore, the backstop operation of the carrier is effected by the carrier itself, not against the traveling rail. A coaxial backstop ring is fixedly installed on the traveling roller of the carrier; a multitude of backstop holes are provided on the circumference of the peripheral surface of the backstop ring; and the base end of the backstop pawl lever having a backstop pawl formed on the free end which goes in the backstop holes is tiltably pivoted on the carrier, so that the backstop pawl on the backstop pawl lever which is supported flat in relation to the peripheral surface of the backstop ring goes in the backstop hole of the backstop ring when the backstop ring turns reversely, thereby preventing the reverse rotation of the traveling rollers of the carrier on which the backstop ring is fixedly mounted, and accordingly preventing the backward travel of the carrier.

FUNCTION

Since the free end of the tiltably pivoted backstop lever is tiltably supported with its own weight on the peripheral surface of the backstop ring, the backstop pawl formed on the free end of the backstop pawl lever easily goes in the backstop hole formed in the peripheral surface of the backstop ring with the weight of its own, thereby preventing the reverse turn of the backstop ring and also preventing the reverse rotation of the traveling rollers of the carrier fixedly mounted on the backstop ring. The carrier therefore will never travel in the reverse direction if the traveling rollers rotate reversely.

BRIEF DESCRIPTION OF THE INVENTION

EMBODIMENT

Figure 1:
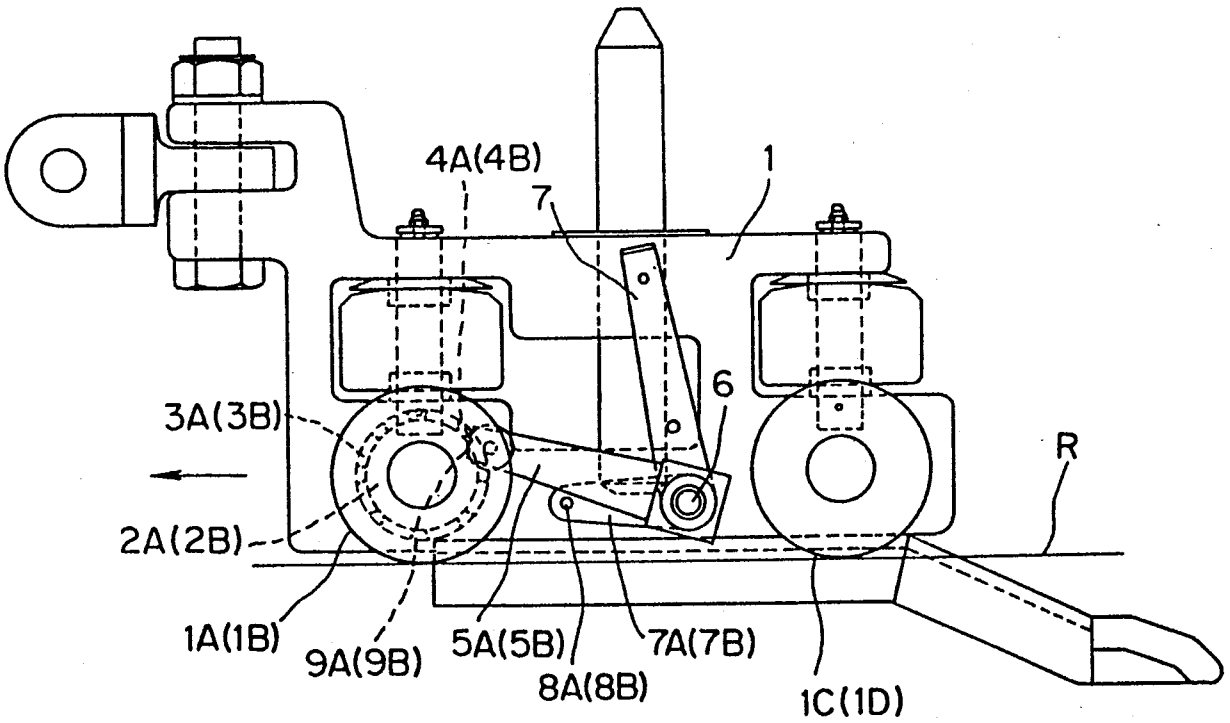
FIG. 1 is a front view of the carrier.
Figure 2:
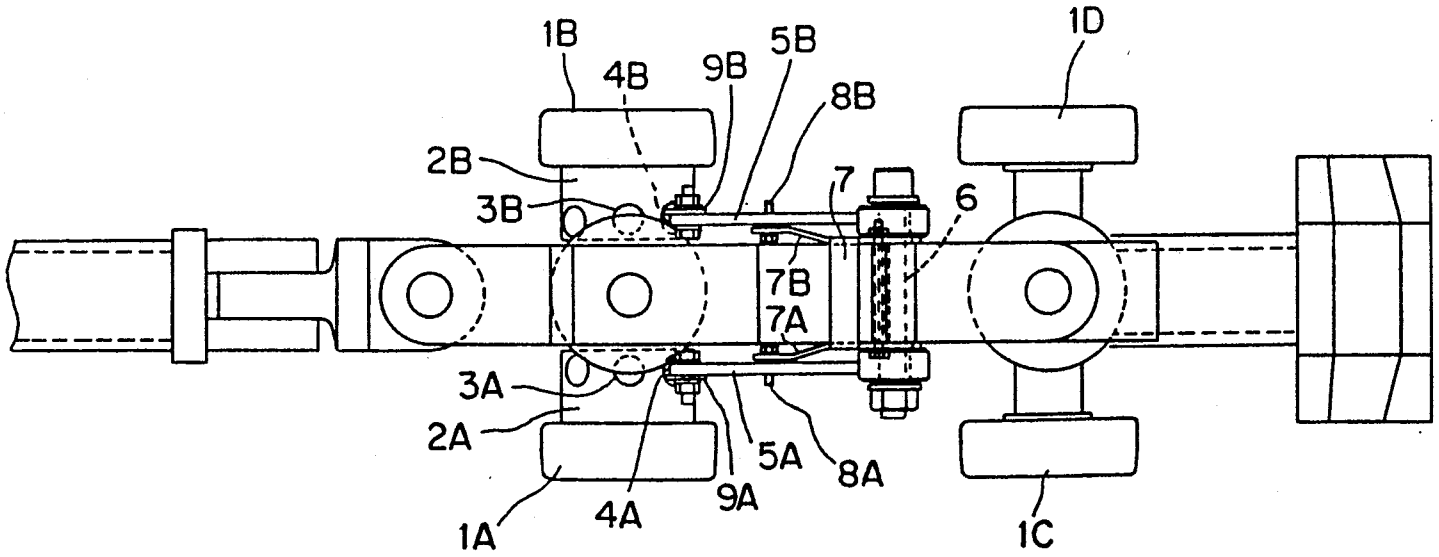
FIG. 2 is a plan view of FIG. 1.
Figure 3:
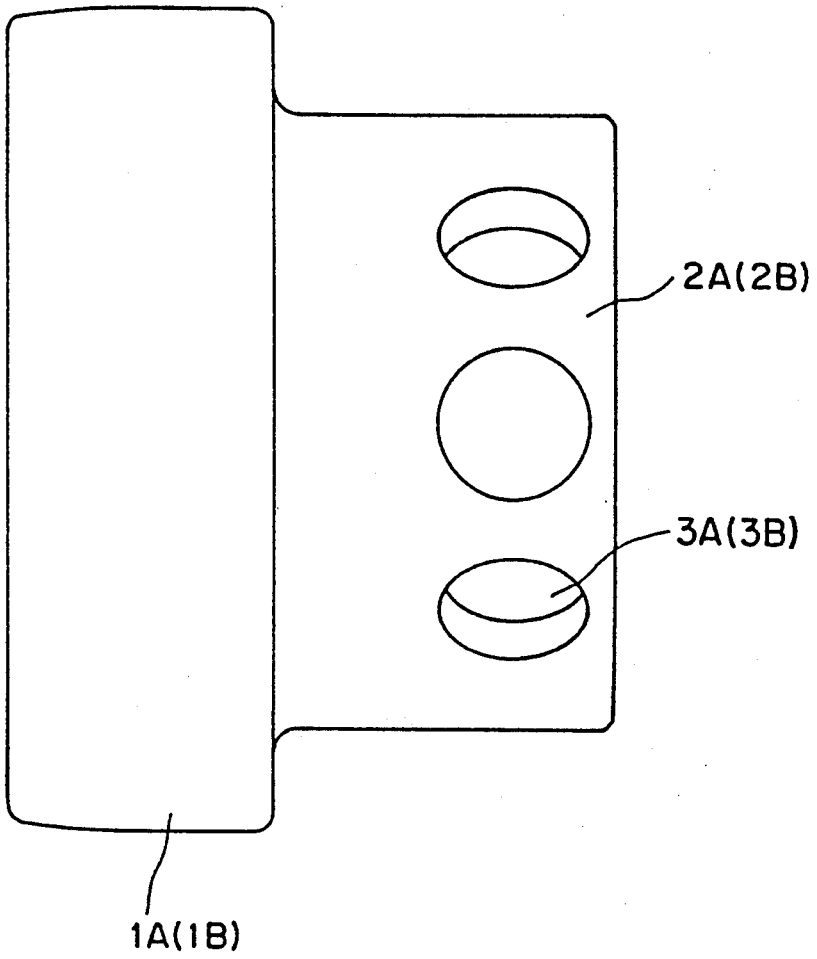
FIG. 3 is an enlarged side view of a major portion of a backstop ring.
Figure 4:
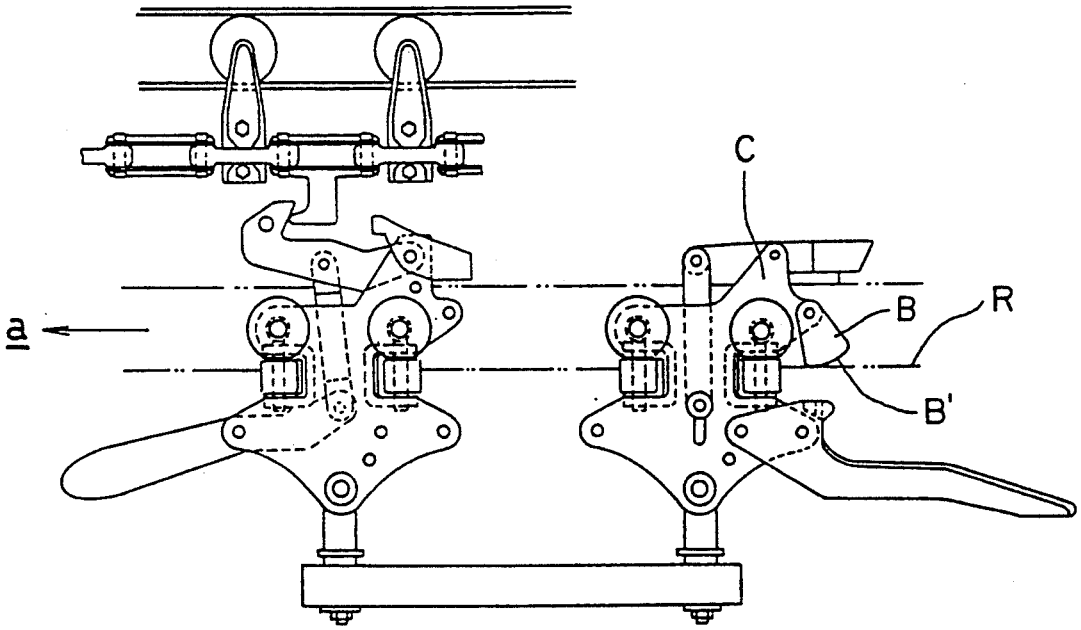
FIG. 4 PRIOR ART
FIG. 4 is a front view of a prior-art carrier.

In FIGS. 1 to 3 showing the embodiment of the present invention, a rear carrier 1 is fitted with traveling rollers 1A, 1B, 1C and 1D, at front, rear, right and left, which rotate on the traveling rail R. The right and left front traveling rollers 1A and 1B has backstop rings 2A and 2B fixedly mounted inside as shown in FIGS. 2 and 3. In the outer peripheral surface on the circumference of the backstop, rings 2A and 2B are formed through many backstop holes 3A and 3B.

The base end of either of backstop pawl levers 5A and 5B having backstop pawls 4A and 4B formed on the free end so as to enter the backstop holes 3A and 3B is tiltably pivoted by a pivot shaft 6 on the rear carrier 1. Furthermore, on the pivot shaft 6 is pivoted an L-shaped lever 7, and operating levers 7A and 7B of the lever 7 are fitted with pins 8A and 8B respectively to support the weight of the backstop pawl levers 5A and 5B. When the lever 7 is tilted, the backstop pawl levers 5A and 5B are raised or inclined; when the backstop pawl levers 5A and 5B are raised, the backstop pawls 4A and 4B are also raised above the peripheral surface of the backstop rings 2A and 2B. When the backstop pawl levers 5A and 5B are inclined, the backstop pawls 4A and 4B are supported with their own weight on the peripheral surface of the backstop rings 2A and 2B.

Furthermore, on the side surface of the backstop pawls 4A and 4B are attached sound-deadening cushion rubber discs 9A and 9B so that the lower side of the backstop lever will not produce a noise when it has dropped against the edge part of the backstop hole when the backstop pawls enter the backstop holes 3A and 3B. The rubber discs 9A and 9B serve also as a cushion to stop the backstop pawls 9A and 9B in the backstop holes 3A and 3B at the time of reverse rotation.

EFFECT OF THE INVENTION

The present invention is designed to prevent the reverse run of the carrier by preventing the rotation of the traveling rollers of the carrier itself, not by locking the carrier on the traveling rail; therefore, if there has occurred a dent in the traveling surface of the carrier traveling rail, the backstop function of the backstop device will never be affected, assuring reliable backstop operation. In addition, while the brake cam of prior art requires a high-accuracy technique in producing a high-accuracy cam profile and a mounting position for mounting the cam shaft, the present invention has such a remarkable practical effect that no high-accuracy technique is required and production of the device can be done easily at low costs since the reverse travel of the carrier can be prevented simply by entering the backstop pawl in the backstop hole.

What is claimed is:

1. A backstop device of a carrier in a trolley conveyor having said carrier riding on a traveling rail in, and out of, engagement with a traveling chain, in which a backstop ring coaxial with traveling rollers is fixedly mounted on the side of said traveling rollers of said carrier; a multitude of backstop holes are provided on the circumference of a peripheral surface of said backstop ring; and a base end of a backstop pawl lever having a backstop pawl formed on the free end to engage in said holes is tiltably pivoted on said carrier.

2. A backstop device of a carrier in a trolley conveyor having said carrier riding on a traveling rail in, and out of, engagement with a traveling chain, in which a pair of backstop rings coaxial with traveling rollers are fixedly mounted on the side of said traveling rollers of said carrier; a multitude of backstop holes are provided on the circumference of peripheral surfaces of said backstop rings; and, base ends of backstop pawl levers having backstop pawls formed on the free ends to engage in said holes are tiltably pivoted on said carrier.

3. A backstop device of a carrier in a trolley conveyor as claimed in claim 2 wherein said backstop pawls include rubber discs mounted thereon.

4. A backstop device of a carrier in a trolley conveyor as claimed in claim 2 wherein said backstop pawl levers extend substantially tangentially relative to said backstop rings.

5. A backstop device of a carrier in a trolley conveyor having said carrier riding on a traveling rail in and out of engagement with a traveling chain, said carrier having travelling rollers, said travelling rollers each having an inside, a backstop ring coaxially and fixedly mounted on said inside of one of said traveling rollers, said backstop ring having a peripheral surface, said backstop ring having a multitude of backstop holes on the circumference of said peripheral surface of said backstop ring, a backstop pawl lever having base and free ends, said base end of said backstop pawl lever tiltably pivoted on said carrier, and said free end of said pawl lever engaging said backstop holes.

6. A backstop device of a carrier in a trolley conveyor as claimed in claim 5 wherein said carrier includes a pair of backstop pawl levers, a pair of backstop pawls, and a pair of backstop rings, each of said backstop pawl levers having base and free ends.

7. A backstop device of a carrier in a trolley conveyor as claimed in claim 6 further including rubber discs mounted on said backstop pawls.

8. A backstop device of a carrier in a trolley conveyor as claimed in claim 7 wherein said backstop pawl levers extend substantially tangentially relative to said backstop rings during engagement with the backstop holes.

* * * * *